US010752045B2

(12) United States Patent
Comey

(10) Patent No.: US 10,752,045 B2
(45) Date of Patent: Aug. 25, 2020

(54) KEY ORGANIZATION APPARATUS AND METHOD OF USE

(71) Applicant: Scott Comey, Snohomish, WA (US)

(72) Inventor: Scott Comey, Snohomish, WA (US)

( * ) Notice: Subject to any disclaimer, the term of this patent is extended or adjusted under 35 U.S.C. 154(b) by 444 days.

(21) Appl. No.: 15/390,625

(22) Filed: Dec. 26, 2016

(65) Prior Publication Data

US 2017/0291445 A1 Oct. 12, 2017

Related U.S. Application Data

(60) Provisional application No. 62/320,528, filed on Apr. 10, 2016.

(51) Int. Cl.

| | |
|---|---|
| ***B42F 5/00*** | (2006.01) |
| ***A45C 11/32*** | (2006.01) |
| ***A45C 13/10*** | (2006.01) |
| ***A45C 13/12*** | (2006.01) |
| ***B65B 5/04*** | (2006.01) |
| ***B42F 13/16*** | (2006.01) |
| ***B42F 3/00*** | (2006.01) |
| ***B42F 7/06*** | (2006.01) |
| *A45C 11/00* | (2006.01) |

(52) U.S. Cl.

CPC ..... *B42F 5/00* (2013.01); *A45C 11/32* (2013.01); *B42F 3/003* (2013.01); *B42F 7/065* (2013.01); *B42F 13/16* (2013.01); *A45C 2011/002* (2013.01); *A45C 2011/322* (2013.01); *A45C 2200/05* (2013.01)

(58) Field of Classification Search

CPC ..... A45C 11/32; A45C 2011/002; A45C 2011/322; A45C 2200/05; B42F 13/16; B42F 3/003; B42F 7/145

See application file for complete search history.

(56) References Cited

U.S. PATENT DOCUMENTS

| | | | | | |
|---|---|---|---|---|---|
| 1,405,136 | A | * | 1/1922 | Ingraham | A45C 11/323 206/38.1 |
| 1,596,055 | A | * | 8/1926 | Charles | A45C 11/32 206/37.5 |
| 1,719,120 | A | * | 7/1929 | Cutler | A45C 11/32 206/37.4 |
| 2,316,655 | A | * | 4/1943 | Henry | A44B 15/00 206/234 |
| 2,780,089 | A | * | 2/1957 | Duell | A45C 11/32 70/456 B |
| 3,209,479 | A | * | 10/1965 | Roger | A45C 11/32 206/37.1 |
| 3,292,680 | A | * | 12/1966 | Broughton | A45C 11/323 206/37.1 |

(Continued)

*Primary Examiner* — Andrew M Tecco
*Assistant Examiner* — Nicholas E Igbokwe
(74) *Attorney, Agent, or Firm* — Thomas E. LaGrandeur; John D. Houvener; Bold IP, PLLC

(57) ABSTRACT

An apparatus and method for the organization of keys using sheets of thin, durable material that have storage pockets for keys and labels with key identification information. The key organization apparatus organizes keys in one physical place by labeling pockets for keys and is easily transportable and stored. The key organization apparatus greatly eases the transition of transferring a set of keys from one person to another, such as a buyer and seller of a house or business.

21 Claims, 2 Drawing Sheets

(56) References Cited

U.S. PATENT DOCUMENTS

| | | | | | |
|---|---|---|---|---|---|
| 3,473,648 | A * | 10/1969 | Paluzzi | A44B 15/00 | 206/0.82 |
| 3,933,017 | A * | 1/1976 | Shee | A47G 29/10 | 70/456 R |
| 4,048,824 | A * | 9/1977 | Blackmon | A45C 11/32 | 70/456 R |
| 4,306,433 | A * | 12/1981 | Kelly | A44B 15/005 | 70/456 R |
| 4,417,612 | A * | 11/1983 | Couture | A45C 11/32 | 206/37.4 |
| D278,574 | S * | 4/1985 | Kilpatrick | D3/207 | |
| 4,886,159 | A * | 12/1989 | Grandy | A45C 11/32 | 206/37.4 |
| 4,909,054 | A * | 3/1990 | Fox | A45C 11/32 | 70/401 |
| 4,951,488 | A * | 8/1990 | Hogan | A45C 11/32 | 70/456 B |
| 7,293,384 | B2 * | 11/2007 | Lewis | G09F 3/0288 | 206/37 |
| 7,900,966 | B1 * | 3/2011 | Stennett | A45C 11/323 | 206/37.1 |
| 2007/0272629 | A1 * | 11/2007 | Spirer | A47B 49/00 | 211/10 |
| 2008/0210577 | A1 * | 9/2008 | Van Handel | A47G 29/10 | 206/1.5 |
| 2011/0068018 | A1 * | 3/2011 | Killeen | A45C 11/32 | 206/37.4 |
| 2014/0266580 | A1 * | 9/2014 | Lopez | G07C 9/00571 | 340/5.6 |
| 2015/0059937 | A1 * | 3/2015 | Singer | A45C 1/06 | 150/147 |

* cited by examiner

KEY ORGANIZATION APPARATUS AND METHOD OF USE

CROSS-REFERENCE TO RELATED APPLICATIONS

The present application is a non-provisional application which claims the benefit of U.S. Provisional Patent Application Number 62/320,528, filed on Apr. 10, 2016, entitled "Key Organization Apparatus and Method of Use," which is incorporated herein by reference in its entirety as if fully set forth herein.

FIELD OF THE DISCLOSURE

This disclosure relates generally to the field of key organization.

BACKGROUND

Everyone at one time has misplaced their keys or became confused regarding what the key unlocked. Keys may be misplaced by busy mothers, fathers, students or any person who carries keys from their home, workplace, or other locations. Misplaced keys may be dropped, misplaced, or placed somewhere by the person that owns the keys. Misplaced keys result in having to rekey the lock, replace spare keys, and programming new keys.

Keys may also be utilized by real estate companies, brokers, sellers, buyers, renters, and family residents. Agents and sellers struggle to collect all the keys in a timely manner. Buyers struggle to get and identify all the keys that should be transferred to them from the seller. Keys may be utilized for entrance doors, garages, storage sheds, lawn mowers, equipment, and mailboxes. Proper and relatively easy identification and distinguishing of keys is also a critical problem as well.

Current key rings and key organizers are noisy, clunky, and time-consuming to fumble with to find the right keys to use, particularly if one has not used the key in a prior instance. Each key is typically not labelled, so it may take several attempts to match the correct key to the locked structure or vehicle. Additionally, if the key rings get lost, it may be extremely difficult to replace the entire set of keys on the key rings or organizers.

For the foregoing reasons, a key organization apparatus would be very useful to a wide spectrum of users, primarily anyone that may utilize any keys. A solution to the problem of misplaced keys and secure key storage is therefore needed by providing a key organization apparatus that physically organizes keys in one physical place.

Accordingly, a key organization apparatus is disclosed, which includes a sheet with labelled pockets.

SUMMARY

The present invention relates to a key organization apparatus comprising a mostly planar sheet; a plurality of storage pockets; and a plurality of labels.

The disclosed invention comprises a key organization apparatus that organizes and labels keys conveniently in one physical place. The key organization apparatus greatly eases the transition of transferring a set of keys from one person to another, such as a buyer and seller of a house or business.

The following embodiments and descriptions are for illustrative purposes only and are not intended to limit the scope of the Key Organization Apparatus and Method of Use. Other aspects and advantages of the present disclosure will become apparent from the following detailed description.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure. Also, the drawings included herein are considered by the applicant to be informal.

Figure 1:
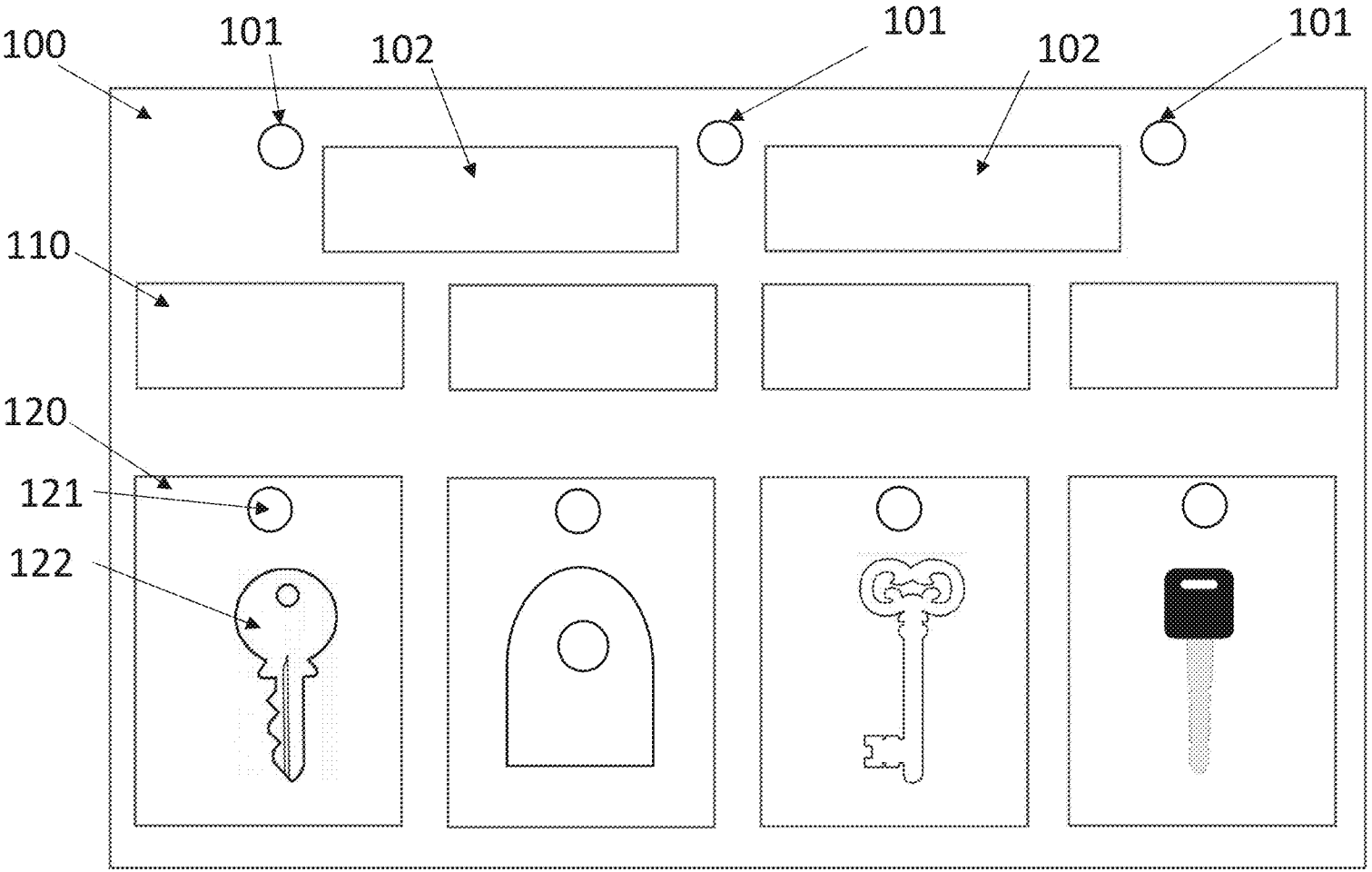
FIG. 1 is a block diagram of an overhead view of a preferred embodiment of a key organization apparatus.

all arranged in accordance with at least some embodiments of the present disclosure.

DETAILED DESCRIPTION

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)—(a second number)," this means a range whose limit is the second number. For example, 25 to 100 mm means a range whose lower limit is 25 mm and upper limit is 100 mm.

The present disclosure is generally drawn, inter alia, to a key organization apparatus and method. In the preferred embodiments, the key organization apparatus is comprised of standard letter sized sheets with four pairs of labels and pockets per sheet. In some embodiments, the labels may be configured with a clear pocket to receive a label on card stock paper, which may be blank for the user to write-in labels or pre-printed with common key uses like Garage Opener, Front Door, Back Door, Slider, Storage Shed, Garage Door, Mailbox, Apartment, Tool Shed, Barn, and Pool House. In the preferred embodiments, the pockets are one to three inches wide, one to three inches tall, and see-through or fashioned in some way to easily see whether a key is in the pocket.

FIG. 1 is a block diagram of an overhead view of a preferred embodiment of a key organization apparatus, arranged in accordance with at least some embodiments of the present disclosure. FIG. 1 includes a sheet 100, an aperture 101, a personalization 102, a label 110, a pocket 120, a fastener 121, and a key 122. In FIG. 1, sheet 100 may be made of material that is durable, thin, and relatively inexpensive, such as plastic, vinyl, wood, chipboard, leather, and cardboard. Sheet 100 is preferably eight inches long but may vary to fit the needs of the user. In some embodiments, sheet 100 may measure 8.5 inches by 14 inches. In some embodiments, sheet 100 may measure 8.5 inches by 11 inches. Sheet 100 may have a background that is solid, patterned, have an image, embossed, or have any possible design that one can think of or find. Aperture 101 is an opening in sheet 100 that allows the user to fasten the sheet with one or more sheets on a ring or loop of some kind or removable fastener known in the art, such as a three-ringed binder. Sheet 100 may have none, one, or more of aperture 101 placed along the margin of sheet 100 as shown in FIG. 1, or along the shorter side of sheet 100.

Personalization 102 is an area that allows for personalizing the key organization apparatus, such as with a company logo, contact information, brand, and image. Personalization 102 may include identifying information of the property tied with the organized keys, such as the actual address of the property, a general or vague description of the property like "Brown Beach House," or a cryptic or coded description of the property, like the street address number followed by the last four digits of the county lot number. Personalization 102 may also include visual or pictorial images rather than alphanumeric, such as a picture of a log cabin for the getaway house, a pool for the pool house, and a country outline of Italy for the vacation house in Italy.

In FIG. 1, label 110 may be aligned and located adjacent to pocket 120. Sheet 100 may have one or more label 110 and corresponding pocket 120 pairs, preferably four pairs of label 110 and pocket 120 per sheet 100. In some embodiments, for example when sheet 100 measures 8.5 inches by 14 inches, there may be 6 pairs of label 110 and pocket 120 per sheet 100. The label 110 and pocket 120 pairs may be oriented and located horizontally, vertically, or in any other fashion on sheet 100 that may be beneficial to users. Label 110 may identify the one or more keys 122 that are contained within pocket 120. Label 110 may include indicia that may include a simple card stock label, a Radio-frequency identification (RFID), an embedded label, a digital display, a light emitting diode (LED) display, and an imprint of one or more tooth marks or functional indicia. Label 110 may be configured with a clear pocket to receive a pre-printed or blank label on card stock paper with perforated edges for easy tear off and to allow for blank labels that may be labelled as the user sees fit. Other cues and information that would allow for a visual/pictorial association with a key may also be used for key labelling. The pre-printed labels may include common uses like Garage Opener, Front Door, Back Door, Slider, Storage Shed, Garage Door, Mailbox, Apartment, Tool Shed, Barn, and Pool House.

Pocket 120 may be located on sheet 100 in any suitable orientation. FIG. 1 illustrates pockets 120 may be located on sheet 100 in a straight column. Pocket 120 may be made of any material that is durable, thin, and flexible, as in the material of sheet 100. Other materials that may possibly be used include plastic, thin rope netting, mesh, vinyl still, glass, rubber, and leather. Pocket 120 is preferably see-through or fashioned in some way to easily see whether a key is in the pocket. Pocket 120 may vary in size and shape, but is preferably one to three inches wide and one to three inches tall. Pocket 120 may contain one or more of key 122.

Pocket 120 may include a fastener 121 to close shut pocket 120 and secure one or more of key 122 within pocket 120. Fastener 121 may be fashioned with a hook and loop fastener, a button, a snap, a zipper, a tie, a lock, or a biometric device. Key 122 may be for any locked structures, equipment, and vehicles, like riding lawnmowers and tractors. Key 122 may be any type of key, including traditional metal keys, plastic cards, RFID, phones, scannables, numeric, audible, and biometric.

One example scenario where the key organization apparatus would be greatly useful is when the owner of a property transfers ownership to another. The owner of the property may first gather and verify keys to open access points. The owner may then add identifying information on the labels of the key organization apparatus and place the corresponding keys inside the pockets of the key organization apparatus. The owner will then have all the keys organized clearly in one place and may store the key organization apparatus until the property sells to a buyer. The owner may then deliver the key organization apparatus to the buyer, who may easily make copies for the use of their purchase. The buyer may store the key organization apparatus in and around the property for later use. The buyer may also subsequently use the already organized keys to add or take away any keys for continued key organization. The buyer may also use the key organization apparatus to transfer keys to an agent for subsequent sale or rent of the property.

Another example scenario where the key organization apparatus would be greatly useful is when the owner of a property infrequently uses the property or allows others to use the property, such as a vacation home. The owner of the property may first gather and verify keys to open access points. The owner may then add identifying information on the labels of the key organization apparatus and place the corresponding keys inside the pockets of the key organization apparatus. The owner will then have all the keys organized clearly in one place and may store the key organization apparatus so that when it comes time to use the property, the user will know which key goes where. This can help the owner who may forget about which key goes where due to infrequent use of the property and may be helpful when others unfamiliar with the property use the property.

The key organization apparatus may be utilized by real estate companies, brokers, sellers, buyers, renters, and family residents and utilized for entrance doors, garages, storage sheds and mailboxes. The key organization apparatus is a device that assists in reminding owners which keys to leave for others, such as buyers. The key organization apparatus makes it easy for buyers to identify which keys goes to what when they move in. The key organization apparatus may be physically organized and labeled in one physical place that may include a binder or a notebook in contrast to a key ring and identifies a side profile of a key with a top label that shows a plurality of tooth marks, so that keys that look identical from approximately 2 to 3 feet away may be distinguished with different teeth marks from each other. The key organization apparatus may be folded from a two-dimensional organizer into a three-dimensional prism or rolled and may be stored in a lockbox. The key organization apparatus may ease transition from one owner to another that include clear and easily distinguished labels for ease of use for making copies. The key organization apparatus may utilize an associated alphanumeric password to code an address assigned to each key label, so that there is a security feature built-in, in the event an undesired person gets a hold of the keys and won't know which residences correspond to which keys and which locks correspond to which keys.

Figure 2:
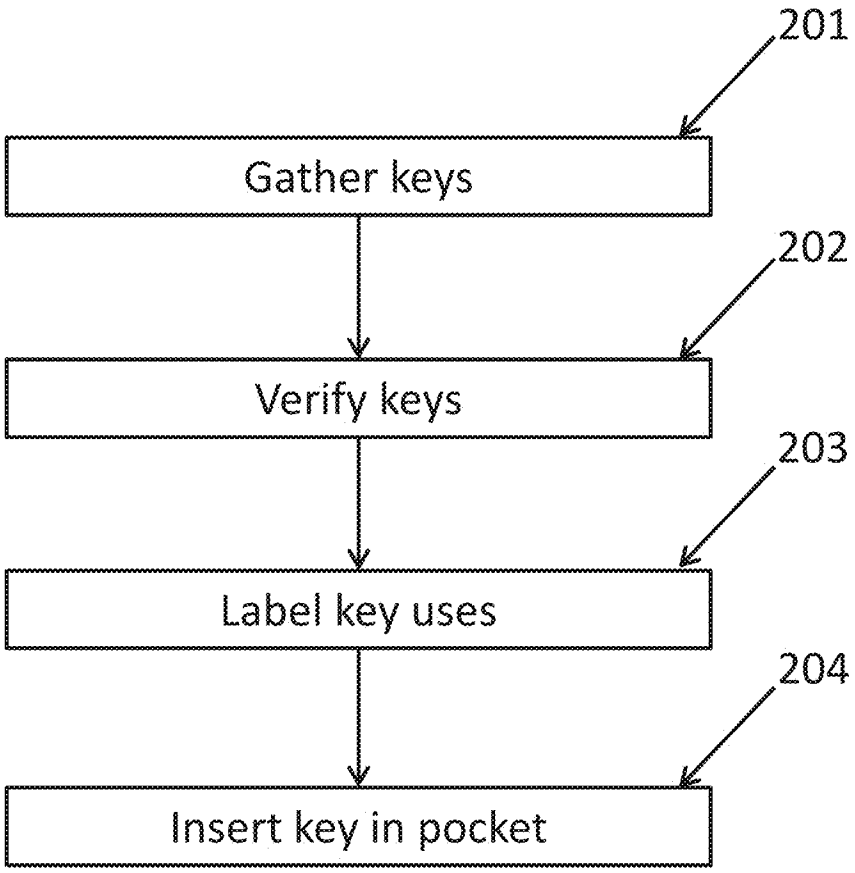
FIG. 2 is a flow diagram of one embodiment of a key organization method.

FIG. 2 is a flow diagram of one embodiment of a key organization method, arranged in accordance with at least some embodiments of the present disclosure. FIG. 2 includes a step 201, a step 202, a step 203, and a step 204.

In FIG. 2, a flow diagram outlining the steps of a key organization method is displayed. In step 201, an owner or agent controlling key access points gathers the keys to the key access points. In step 202, an owner or agent of the property verifies that each of the gathered keys opens each of the corresponding access points. In step 203, the key uses are labelled on the label area of the key organization apparatus. In step 204, the keys are inserted in the pockets corresponding to the correct label. In addition, they keys may be secured in the pockets by fasteners.

While preferred and alternate embodiments have been illustrated and described, as noted above, many changes can be made without departing from the spirit and scope of the key organization apparatus and method. Accordingly, the scope of the key organization apparatus and method is not limited by the disclosure of these preferred and alternate embodiments. Instead, the scope of the key organization apparatus and method should be determined entirely by reference to the claims. Insofar as the description above and the accompanying drawings (if any) disclose any additional subject matter that is not within the scope of the claims below, the inventions are not dedicated to the public and Applicant hereby reserves the right to file one or more applications to claim such additional inventions.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. § 112 ¶116. In particular, the use of "step of" in the claims herein is not intended to invoke the provisions of U.S.C. § 112 ¶116.

What is claimed is:

1. An apparatus for the organization of keys, consisting of:

a single sheet with a first side, the first side consisting of a row of four horizontally aligned, see through key pockets for containing at least one key per pocket;

the first side further consisting of a row of four horizontally aligned, see through label pockets that vertically align with the key pockets to form a total of four columns, with each column containing a single key pocket and a single label pocket, wherein each label pocket in a column is for containing a label that identifies the at least one key contained in the key pocket in the column, and;

the first side further consisting of a first open, uncovered area that lies outside of the key pocket and label pocket rows, the first open area for receiving a personalized image on the single sheet.

2. The apparatus of claim 1, wherein the at least one personalized image is selected from a group consisting of a company logo, contact information, brand image, and combinations thereof.

3. The apparatus of claim 1, wherein the key pocket comprises a fastener to close-up the pocket.

4. The apparatus of claim 1, the first side further consisting of a second open, uncovered area that lies outside of the key pocket and label pocket rows, the second open area for receiving a personalized image on the single sheet.

5. The apparatus of claim 4, wherein the first and second open, uncovered areas form a row of horizontally aligned open, uncovered areas for receiving a personalized image on the single sheet.

6. The apparatus of claim 5, wherein the row of key pockets is adjacent to a first edge of the single sheet, the row of uncovered areas for receiving personalized images is adjacent to a second, opposite edge of the single sheet, and the row of label pockets lies between the row of key pockets and the row of personalized images.

7. The apparatus of claim 6, wherein the first side of the single sheet further consists of a first gap of uncovered space between the row of key pockets and the row of label pockets and a second gap of uncovered space between the row of label pockets and the row of uncovered areas for receiving personalization.

8. The apparatus of claim 1, wherein the single sheet further consists of at least one aperture adjacent to one edge of the sheet above the area for receiving a personalized image.

9. The apparatus of claim 1, wherein the first side of the single sheet further consists of a gap of uncovered space between the row of key pockets and the row of label pockets.

10. The apparatus of claim 1, wherein each key pocket is configured to contain a label with a key identifier, wherein the label is a label preprinted with an identifier or a label that was printed by a user onto an originally blank label.

11. The apparatus of claim 10, wherein each label is formed from card stock.

12. The apparatus of claim 11, wherein the label consists of a radiofrequency identification (RFID), an embedded label, a digital display, or a light emitting diode (LED) display.

13. An apparatus for the organization of keys, consisting of:

a single sheet with a first side, the first side consisting of a row of four horizontally aligned key pockets for containing at least one key per pocket;

the first side further consisting of a row of four horizontally aligned labels that vertically align with the key pockets to form a total of four columns, with each column containing a single key pocket and a single label, wherein each label in a column identifies the at least one key contained in the key pocket in the column; and;

the first side further consisting of a first open, uncovered area that lies outside of the key pocket and label rows, the first open area for receiving a personalized image on the single sheet.

14. The apparatus of claim 13, wherein the key pockets are see through pockets.

15. The apparatus of claim 13, wherein the row of key pockets is adjacent to a first edge of the single sheet, the row of uncovered, open areas for receiving personalized images is adjacent to a second, opposite edge of the single sheet, and the row of labels lies between the row of key pockets and the row of personalized images.

16. The apparatus of claim 15, wherein the first side of the single sheet further consists of a first gap of uncovered space between the row of key pockets and the row of label pockets, and a second gap of uncovered space between the row of key pockets and the row of uncovered, open areas for receiving personalized images.

17. The apparatus of claim 13, the first side further consisting of a second open, uncovered area that lies outside of the key pocket and label rows, the second open area for receiving a personalized image on the single sheet.

18. The apparatus of claim 17, wherein the first and second uncovered areas form a row of horizontally aligned uncovered areas for receiving a personalized image on the single sheet.

19. An apparatus for the organization of keys, consisting of:

a single sheet with a first side, the first side consisting of a row of six horizontally aligned key pockets for containing at least one key per pocket;

the first side further consisting of a row of six horizontally aligned labels that vertically align with the key pockets to form a total of six columns, with each column containing a single key pocket and a single label, wherein each label in a column identifies the at least one key contained in the key pocket in the column; and;

the first side further consisting of a first open, uncovered area that lies outside of the key pocket and label rows, the first open area for receiving a personalized image on the single sheet.

20. The apparatus of claim 12, wherein the key pockets are see through pockets.

21. The apparatus of claim 19, wherein the labels are contained within see through label pockets.

* * * * *